United States Patent [19]

Radd et al.

[11] Patent Number: 4,493,372

[45] Date of Patent: Jan. 15, 1985

[54] WELL COMPLETION SYSTEM AND PROCESS

[75] Inventors: Fred J. Radd; James B. Scott, both of Ponca City, Okla.; Robert B. Pan, Calgary, Canada

[73] Assignee: Conoco Inc., Ponca City, Okla.

[21] Appl. No.: 493,468

[22] Filed: May 11, 1983

[51] Int. Cl.[3] ..... E21B 33/14

[52] U.S. Cl. ..... 166/285; 166/242

[58] Field of Search ..... 166/285, 286, 242

[56] References Cited

U.S. PATENT DOCUMENTS

| | | | |
|---|---|---|---|
| 3,205,945 | 9/1965 | Holt et al. | 166/23 |
| 3,255,819 | 6/1966 | Scott et al. | 166/21 |
| 3,467,193 | 9/1969 | Messenger | 166/292 |
| 3,982,590 | 9/1976 | Harriman | 166/285 |

OTHER PUBLICATIONS

"Sand-Coated Casing Aids Cement Jobs", The Oil and Gas Journal, Aug. 19, 1963.

"Rod Welded to Casing Helps Cementing" by Holt et al.; World Oil, Jul. 1964.

*Primary Examiner*—Stephen J. Novosad

*Assistant Examiner*—William P. Neuder

*Attorney, Agent, or Firm*—A. Joe Reinert

[57] ABSTRACT

Well completion system providing for an enhanced bond between a well casing and the surrounding cement sheath. The system comprises a string of casing disposed within a well extending to a subterranean location in the earth. A wrapping of a metal wire is disposed about the outer surface of the casing in a conformation providing a plurality of helical turns which crisscross on another. A cement sheath in the annulus about the casing encompasses the metal wire to provide an enhanced bond between the cement and the outer surface of the casing. The wire may be provided with a plurality of protrusion elements which extend into the cement sheath to further increase the casing cement bond.

2 Claims, 7 Drawing Figures

FIG. 1
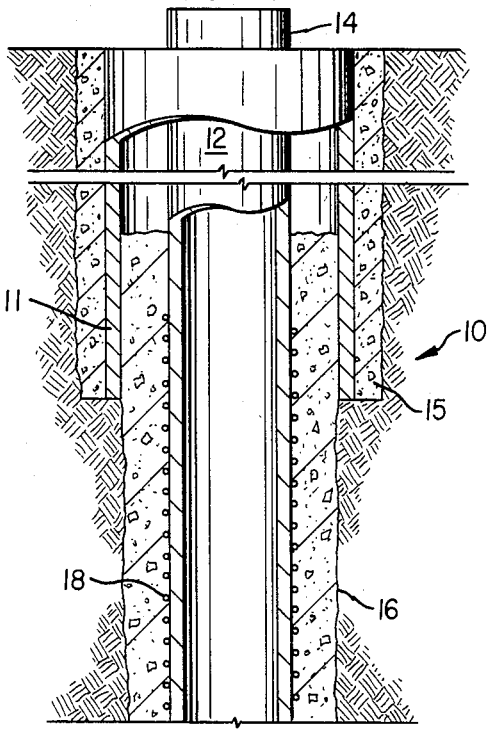
FIG. 4a
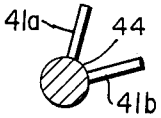
FIG. 4b
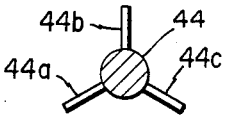
FIG. 4c
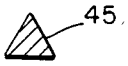
FIG. 4d
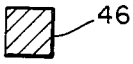
FIG. 2
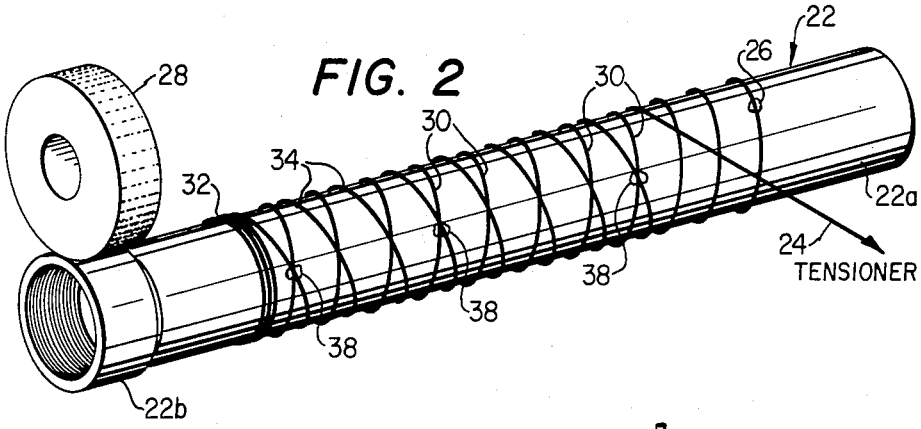
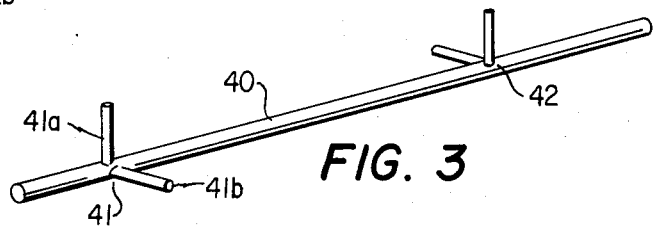
FIG. 3

WELL COMPLETION SYSTEM AND PROCESS

DESCRIPTION

1. Technical Field

This invention relates to the completion of wells and more particularly to well completion systems and processes providing for improved bonding between a casing string and a surrounding cement sheath.

2. Background of the Invention

There are various applications in which wells are extended to subterranean locations in the earth's crust. For example, wells are drilled into subterranean formations in order to provide for the production of fluids, such as water, gas or oil, or for the injection of fluids, such as in salt water disposal and in gas or water injection techniques employed in the secondary and tertiary recovery of oil. In order to support the wall of the well and to exclude undesirable fluids from the well, the well is cased with one or more strings of pipe. Typically, the well will be provided with at least a surface or conductor casing and a production string extending to the desired subterranean formation. Particularly in relatively deep wells, one or more intermediate strings of casing may also be employed.

In order to provide for the desired exclusion of fluids, one or more casing strings within the well are cemented in place. The typical well cementing procedure involves pumping a hydraulic cement slurry through the casing to the bottom thereof and then upwardly through the annulus between the outer surface of the casing and the surrounding wall structure, i.e., the wall of the well or the inner wall of an outer casing string. After the cement slurry is in place, it is allowed to set, forming an impermeable sheath which, assuming that good bonds are achieved, prevents the migration of fluids through the annulus surrounding the casing.

There are a number of commonly encountered problems in well completion operations. These include the lack of homogeneous distribution of cement within the casing annulus, thus resulting in vugs or channels within the cement sheath, and poor or incomplete bonding between the cement and the adjacent interfaces. Bonding problems may be encountered at the interface between the cement and the outer surface of the casing and the interface between the cement and the surrounding wall structure. This latter problem is particularly serious where the interface is provided by the wall of the well, i.e., the face of the formation exposed in the well.

A number of procedures have been proposed in order to alleviate one or more of these difficulties. Thus, U.S. Pat. No. 3,205,945 to Holt et al discloses a well completion process in which a hot rolled steel rod in the form of a pre-formed spiral is welded to the outside of the casing at each 180° of the spiral. In this well completion process, the casing is first reciprocated with a 10-foot stroke prior to beginning the cementing operation. During the course of flowing the cement slurry into place, the casing string (and its attached spiral rod) is rotated until the cement stiffens. This procedure is said to cause a tamping and troweling action, a kneading of the cement which eliminates entrained air leading to channels, and a strong bond between the cement sheath and the casing. Furthermore, the pressures otherwise needed for high turbulent flow to provide a good mixing of the cement are avoided.

Poor bonding between the cement sheath and the wall of the well often results from the presence of the filter cake lining the wall following the drilling operation. Various procedures have been employed to remove the filter cake prior to the cementing procedure. For example, it is a conventional practice to remove or at least disrupt the filter cake by means of scratcher elements secured to the external surface of the casing. These abrade the wall of the well as the casing is lowered into place. Another technique involves achieving turbulent flow conditions within the casing annulus as the cement slurry is pumped into place. For example, U.S. Pat. No. 3,467,193 to Messenger discloses a well completion procedure employing successive cement slurries containing a turbulence inducer in order to provide for turbulent flow through the annular space between the casing and the wall of the well. The cement slugs may be preceded by a preflush, also in turbulent flow.

In order to improve the bond between the outer surface of the casing and the surrounding cement sheath, a commonly used procedure is to form a scabrous surface on the exterior of the casing string prior to the cement operation. Thus, U.S. Pat. No. 3,255,819 to Scott et al discloses that a scabrous surface can be formed on the exterior casing surface by reducing the exterior surface of the casing or by adding particulate material to this surface. Thus, the conduit may be subjected to knurling, abrading, etching or quilting procedures; or a particulate solid such as sand, rock, gravel, shell, frit, metal, metal shavings and the like can be applied to the exterior casing surface by means of a suitable adhesive material. Particularly disclosed in Scott et al is the use of sand in an adhesive matrix formed of an epoxy resin.

DISCLOSURE OF THE INVENTION

In accordance with the present invention, there is provided a new and improved well-completion process and structure providing for an enhanced hydraulic bond between a well casing and a surrounding cement sheath. The structure of the present invention comprises a string of casing disposed within a well extending to a subterranean location within the earth's crust. A wrapping of a metal wire is disposed about the outer surface of the casing in a conformation providing a plurality of helical turns which crisscross one another. The well is provided with a cement sheath in the annulus about the casing. The cement sheath encompasses the metal wire to provide a bond between the cement and the casing surface. In a preferred embodiment of the invention, the metal wire has a plurality of protrusions extending into the cement sheath.

In a further aspect of the invention, there is provided a well-completion process in which a cement-coated conduit is installed within a well. In carrying out this process, a metal wire is secured to the conduit at a first location thereon. The wire is pulled under tension and wrapped about the conduit in a manner providing a first series of successive helical turns about the conduit. The direction of wrapping of the metal wire is then reversed at a second location on the conduit spaced longitudinally from the first location and the wire is then wrapped about the conduit to provide a second series of successive helical turns which overlap the turns in the first series. The conduit is then installed in the well at the desired location and a slurry of hydraulic cement is flowed into the annulus about the conduit. The slurry is allowed to set, thus forming a cement sheath which encompasses the metal wire and is bonded to the conduit.

BRIEF DESCRIPTION OF THE DRAWINGS

FIG. 1 is a schematic illustration, partially in section, showing a well completed in accordance with the present invention;

FIG. 2 is a perspective view of a conduit being wrapped with metal wire in accordance with the present invention;

FIG. 3 is a perspective view of a preferred form of metal wire employed in the present invention; and FIG. 4*a*–4*d* are illustrations of cross-sectional configurations of metal wire employed in accordance with the present invention;

BEST MODES FOR CARRYING OUT THE INVENTION

While the present invention may be employed in the completion of any type of well having a cemented casing string, it is particularly applicable to wells which are to be subjected to high temperature conditions. Such conditions are found in thermal oil recovery applications in which a heated fluid, e.g., steam or hot water is introduced through an injection well into a subterranean oil-bearing formation. Other circumstances involve the production of hot fluids from a subterranean formation such as in the recovery of oil by in situ combustion or in geothermal recovery techniques where high temperature steam is recovered. In such applications, the well is subjected to downhole temperatures ranging from about 300° F. to 600° F., or even higher, and the resultant thermal expansion of the casing places the hydraulic bond between the casing and cement sheath under stress. Such thermal stressing is exacerbated in cases where the well encounters alternate cycles of heating and cooling. For example, in the so-called "huff and puff" steam recovery processes, steam is injected down the well for a period of hours or days. Steam injection is then terminated and the well is placed on production to recover the heated oil, which is at a relatively cool temperature in relation to the steam injection temperature.

The cement employed in carrying out the present invention may be of any suitable type. Typically, the cement will take the form of portland type cements or, in the case of high temperature applications, alumina-type cements such as pozzolan cement, in "neat" slurries, i.e., without the addition of aggregate. However, the hydraulic cement may be employed in slurries containing aggregates such as sand, gravel, perlite and the like.

Turning now to FIG. 1 of the drawing, there is illustrated a well bore 10 which extends to a suitable subterranean location (not shown) in the earth's crust. The well is equipped with a surface or conductor casing 11, normally extending to a depth of several hundred feet, and a primary casing string 12, e.g., a production string in the case of an oil well, extending to the desired subterranean formation. The casing string 12 may be set to the top of the formation with the well drilled further in an "openhole" completion format, or it may extend through the formation and the well completed by a suitable perforation procedure. Such completion techniques are well known to those skilled in the art and will not be described further. Also, it would be recognized that while only two casing strings are shown, both of which are suspended from the wellhead 14, other intermediate strings may be provided and the casing strings may be suspended from the wellhead or from the bottom of larger casing strings.

The casing strings 11 and 12 are surrounded by cement sheaths 15 and 16, respectively. A metal wire 18 is wrapped about the casing 12 in a spiral conformation to provide a plurality of helical turns along the length of the casing. The helical turns of the metal wire overlap one another, as described in greater detail hereinafter, to provide a crisscross relationship. Preferably, overlapping turns of the wire are secured to one another at spaced-apart locations along the casing 12 in order to increase the integrity of the wrapping. The wire may be of any suitable stock which will retain it structural integrity at the temperatures on the order of 600° F. which may be encountered in high temperature well operations. Typically, 4 to 20 gauge steel wire may be employed.

Prior to the wrapping operations, it usually will be desirable to treat the outer surface of the casing to remove extraneous material which would interfere with the casing-cement bond. For example, the casing may be subjected to a sand blasting operation in order to remove the mill varnish which is normally found on the casing when it is delivered to the field. A freshly-cleaned rough metal surface will also enhance the wire wrap bonding as well as the quality of the cement/steel bonding.

The wrapping of the casing prior to insertion into the wellbore can be carried out by any suitable technique. The wrapping operation can be carried out on the rig floor after several joints of pipe are made up in a stand, or may be carried out externally, e.g., on a pipe rack. In either case, it usually will be convenient to rotate the pipe during the wrapping operation while moving the metal wire longitudinally along the metal pipe. Preferably, the pipe is wrapped in a manner to provide a first series of successive turns in one direction along the conduit followed by a second series of successive turns in the reverse direction so that the second series of turn double back upon and overlap the first series of turns. The wrapping of a pipe in this manner is illustrated in FIG. 2, which is a perspective view of a casing joint 22 undergoing wrapping with a metal wire 24. As illustrated in FIG. 2, the metal wire 24 is secured to the pipe 22 near one end **22*a* thereof by any suitable means such as a spot weld 26. The pipe is supported on a suitable pipe rack (not shown) and is rotated by a friction drive arrangement indicated schematically by friction wheel 28**.

After the wire is spot welded or otherwise secured to the pipe at location 26, it is pulled in a direction toward the end **22*b* of the pipe to produce a first series of successive helical turns indicated by reference numeral 30. Wrapping in this direction continues until the spiral wrapping reaches the desired location 32 adjacent end 22*b* at which time the direction of wrapping is reversed (to the orientation shown in FIG. 2) and continues to provide a second series of successive helical turns indicated by reference numeral 34. Wrapping of the wire under tension in the direction indicated by the arrow is continued until a position near the end 22*a* of the tubing is reached, at which time the wire is secured to the tubing by any suitable means such as spot welding. In addition, it will be preferred to secure the overlapping turns of the wire to each other at spaced apart locations along the pipe 22. For example, the overlapping turns may be spot welded to each other at each fifth set of turns as indicated by reference character 38**. The spacing between successive turns will vary depending upon the size of the pipe and desired hydraulic bond strength between the cement sheath and the pipe. For a typical casing, e.g., having a diameter of about 5½ inches, the spacing between adjacent helical turns of wire may range from about 1 to 4 inches.

Preferably, the wrapping wire has a plurality of protrusions, e.g., of the type found in barbed wire and the like, which extend outwardly from the wire into the cement sheath. A configuration of the wire in accordance with this embodiment of the invention is illustrated in FIG. 3. As shown in the perspective view of FIG. 3, a wire 40 is provided with protrusion elements 41 and 42 which typically will be spaced apart by about 1 to 6 inches. As shown in FIG. 3, each protrusion element preferably has a plurality of legs or prongs as indicated by reference numberals 41*a* and 41*b* in angular configuration to insure that at least that one leg extends into the cement sheath rather than lying along the surface of the pipe. As described below, a preferred form wire protrusion element comprises at least three prongs in a stelliform configuration which provides a standoff relationship between the outer surface of the casing and portions of the wire.

Turning now to FIG. 4, various cross sectional configurations of wire which may be employed in the present invention are illustrated in subfigures *a, b, c* and *d*. In FIG. 4*a*, dual prong protrusion elements of the type shown in FIG. 3 are illustrated. Typically the angle between the legs 41*a* and 41*b* will range from about 60–120° in order to assure that at least one leg extends outwardly from the casing surface. A stelliform protrusion element is shown in FIG. 4*b* and comprises prongs 44*a*, 44*b* and 44*c* extending outwardly from wire 44. As can be seen from an examination of FIG. 4*b*. As the wire is wrapped around the pipe, it must, of necessity, stand off somewhat from the outer pipe surface at the location of the protrusion elements. This relationship will tend to enhance the casing cement bond.

FIGS. 4*c* and 4*d* illustrate alternative polygonal cross sectional configurations which may be employed in the wrapping wire. Typically, where a noncircular wire is employed, it will be triangular or rectangular in cross section as illustrated by wires 45 and 46, respectively. A wire of a polygonal cross section may be employed where it is desired to increase the surface area contact between the wire and the outer surface of the casing.

While the configurations illustrated in FIGS. 3 and 4 are single strands, wires formed of multiple strands may also be used in the present invention. Thus, the wrapping wire may be composed of two or more strands which are twisted together such as in the case of barbed wire. The resulting irregular surface of the wire will provide increased surface contact between the wire and cement to strengthen the cement bond. Where single strand wire is used, it also may be roughened or formed with a corrugate surface along its length to increase the bond strength.

In addition to increasing the bond between the outer surface of the casing and the cement, the irregular surface provided by the wrapping wire acts to increase the tendency of the cement slurry to flow in turbulence as it is pumped into the annulus between the casing and the wall of the well. As noted previously, turbulent flow of the slurry during the cementing step acts to disrupt the filter cake on the wall of the wellbore, thus enhancing the bond at the outer surface of the cement sheath. A turbulence-inducer may be added to the cement slurry in order to augment the tendency for turbulent flow. Suitable turbulenceinducers are water soluble alkyl aryl sulfonates, polyphosphates, lignosulfonates and synthetic polymers and organic acids. Such turbulence inducers are well known to those skilled in the art and, for a further description thereof and their use in well cementing operations, reference is made to the aforementioned patent to Messenger. The protrusion elements of the metal ribbon, in addition to strengthing the casing-cement bond, also tends to promote turbulent flow of the cement slurry.

Having described specific embodiments of the present invention, it will be understood that modifications thereof may be suggested to those skilled in the art, and it is intended to cover all such modifications as fall within the scope of the appended claims.

What is claimed is:

1. In a well extending to a subterranean location in the earth's crust, the combination comprising:

(a) a string of casing located in said well;

(b) a wrapping of metal wire about the outer surface of said casing in a conformation providing a plurality of helical turns which criss-cross one another; and (c) a cement sheath in the annulus about said casing and encompassing said metal wire whereby said cement is bonded to said casing;

the combination further comprising a pluality of protrusion elements on said wire extending into said cement sheath, wherein said protrusion elements have a plurality of prongs in an angular configuration.

2. The combination of claim 1 wherein said protursion elements have at least three prongs in a stelliform configuration providing a standoff relationship between the outer surface of said casing and portions of said metal strapping.

* * * * *